US008864512B2

(12) United States Patent
Inomae

(10) Patent No.: US 8,864,512 B2
(45) Date of Patent: Oct. 21, 2014

(54) ELECTRICAL CONNECTOR

(71) Applicant: Dai-Ichi Seiko Co., Ltd., Kyoto (JP)

(72) Inventor: Koichi Inomae, Tokyo (JP)

(73) Assignee: Dai-Ichi Seiko Co, Ltd., Kyoto (JP)

( * ) Notice: Subject to any disclaimer, the term of this patent is extended or adjusted under 35 U.S.C. 154(b) by 32 days.

(21) Appl. No.: 13/781,538

(22) Filed: Feb. 28, 2013

(65) Prior Publication Data

US 2013/0237098 A1 Sep. 12, 2013

(30) Foreign Application Priority Data

Mar. 9, 2012 (JP) ..... 2012-053107

(51) Int. Cl.

| | |
|---|---|
| ***H01R 13/62*** | (2006.01) |
| ***H01R 12/77*** | (2011.01) |
| ***H01R 12/88*** | (2011.01) |
| ***H01R 12/79*** | (2011.01) |

(52) U.S. Cl.

CPC ..... *H01R 12/88* (2013.01); *H01R 12/774* (2013.01); *H01R 12/79* (2013.01)

USPC ..... 439/260

(58) Field of Classification Search

CPC ..... H01R 23/684; H01R 23/668

USPC ..... 439/260, 261, 495

See application file for complete search history.

(56) References Cited

U.S. PATENT DOCUMENTS

| | | | | |
|---|---|---|---|---|
| 5,785,549 | A * | 7/1998 | Takayasu | 439/495 |
| 6,851,968 | B2 * | 2/2005 | Tsunematsu | 439/495 |
| 7,445,493 | B2 * | 11/2008 | Takahira | 439/495 |
| 2002/0045374 | A1 * | 4/2002 | Kunishi et al. | 439/260 |
| 2006/0105622 | A1 | 5/2006 | Nakano et al. | |
| 2008/0113542 | A1 * | 5/2008 | Sunaga | 439/260 |
| 2008/0254662 | A1 | 10/2008 | Koga | |

FOREIGN PATENT DOCUMENTS

| | | | |
|---|---|---|---|
| EP | 1816708 | A1 | 8/2007 |
| JP | 2004-342426 | A | 12/2004 |

* cited by examiner

*Primary Examiner* — Phuongchi T Nguyen

(74) *Attorney, Agent, or Firm* — Studebaker & Brackett PC

(57) ABSTRACT

An electrical connector including a housing, a plurality of conductive contacts arranged on the housing, an actuator provided to be rotatable for taking up first and second stations selectively and operative to cause each of the conductive contacts to come into press-contact with one of connecting terminals on the flat circuit device inserted into the housing with shifting from the first station to the second station and to release each of the conductive contacts from the press-contact with the connecting terminal with shifting from the second station to the first station, and an engaging member for engaging with the actuator to hold the same so that the actuator is prevented from being removed from the housing and for engaging with the flat circuit device inserted into the housing to hold the same so that the flat circuit device is prevented from getting out of the housing.

4 Claims, 12 Drawing Sheets

ELECTRICAL CONNECTOR

BACKGROUND OF THE INVENTION

1. Field of the Invention

The present invention relates generally to electrical connectors, and more particularly to an improvement in an electrical connector provided to be fixed to and connected electrically with a circuit board device, such as a main solid circuit board of an electronic apparatus, and to have a plurality of conductive contacts for coming into press-contact with connecting terminals provided on a flat circuit device, such as a flexible printed circuit board (hereinafter, referred to as an FPC) or a flexible flat cable assembly (hereinafter, referred to as an FFC), so as to put the connecting terminals on the flat circuit device in electrical connection with the circuit board device.

2. Description of Related Art Including Information Disclosed Under 37 CFR 1.97 and 37 CFR 1.98

A flat circuit device, such as a relatively small-sized FPC or FFC, used in electronic apparatus of various kinds is often mounted on a circuit board device, on which various electrical parts are directly mounted, by means of an electrical connector which is fixed to and connected electrically with the circuit board device. The electrical connector has a plurality of conductive contacts for coming into contact with connecting terminals provided on the flat circuit device and is operative to connect electrically, through the conductive contacts, the connecting terminals provided on the flat circuit device with conductive circuit pattern portions formed on the circuit board device.

One of previously proposed electrical connectors, which is used for mounting a flat circuit device which is, for example, an FPC on a circuit board device, is provided with a housing made of insulator which has an opening through which the flat circuit device is inserted into the housing and is to be mounted on the circuit board device. In the housing, a plurality of conductive contacts are provided to be arranged along the opening. These conductive contacts are operative to come into contact respectively with a plurality of connecting terminals provided on the flat circuit device when the flat circuit device is inserted into the housing through the opening. The electrical connector is further provided with an actuator which is provided to be rotatable to the housing so as to engage with each of the conductive contacts arranged on the housing. When the actuator is rotated in regard to the housing, an operating portion of each of the conductive contacts is moved by the actuator to put the conductive contact in press-contact with a corresponding one of the connecting terminals provided on the flat circuit device.

The actuator is formed into a slender shape elongating in a direction along which the conductive contacts are arranged and provided with a cam portion and a manipulatable portion. The cam portion of the actuator is put in engagement with each of the conductive contacts. The manipulatable portion of the actuator is manipulated for causing the actuator to rotate in regard to the housing.

Each of the conductive contacts arranged on the housing is made of conductive resilient material to have a fixed part fixed to the housing and a movable part coupled through a connecting part with the fixed part for constituting the operating portion. The fixed part of the conductive contact is connected electrically with a conductive circuit pattern portion provided on the circuit board device on which the housing is mounted. The movable part of the conductive contact is provided thereon with a contacting projection for coming into press-contact with the connecting terminal provided on the flat circuit device and shifted in place by the cam portion of the actuator.

In the electrical connector proposed previously, when the flat circuit device has been inserted into the housing through the opening provided thereon and the actuator is rotated in a predetermined direction, the actuator operates to move the movable part of each of the conductive contacts for causing the contacting projection provided on the movable part to come into press-contact with a corresponding one of the connecting terminals provided on the flat circuit device, and then, when contacting projection provided on the movable part of each of the conductive contacts is put in a condition of press-contact with the connecting terminal provided on the flat circuit device and the actuator is rotated in a direction opposite to the above-mentioned predetermined direction, the actuator operates to move the movable part of each of the conductive contacts for releasing the contacting projection provided on the movable part from the condition of press-contact with the connecting terminal provided on the flat circuit device.

In such an electrical connector as mentioned above, the actuator is required to be prevented from being unwillingly removed from the housing, for example, when the actuator is manipulated to rotate in regard to the housing. Further, since the electrical connector is generally desired to be minimized in its size of thickness on the circuit board device on which the housing is mounted so as to be miniaturized on the whole, the actuator is also desired to be prevented from causing unwilling removal from the housing with a relatively simple and miniaturized structure in the electrical connector.

Accordingly, there has been also proposed previously an electrical connector in which an actuator which is put in engagement with a plurality of conductive contacts which are arranged in a housing and with which an actuator is put in engagement are operative to hold the actuator so as to prevent the actuator from being unwillingly removed from the housing, as shown in, for example, the Japanese patent application published before examination under publication number 2004-342426 (hereinafter, referred to as a published Japanese patent document).

In the previously proposed electrical connector shown in the above-mentioned published Japanese patent document, a plurality of first conductive contacts (first conductive contacts (10)) and a plurality of second conductive contacts (second conductive contacts (20)) are arranged one after the other in a housing (an insulator (30)) which is provided to be mounted on a circuit board device and an actuator (a rotatable member (40)) is provided to be rotatable in regard to the housing and put in engagement with each of the first and second conductive contacts. Each of the first conductive contacts is provided thereon with a holding portion (11*b*) for engaging with the actuator to hold the same. The actuator is postured to take up first and second stations selectively. In the first station, the actuator keeps rising from the housing, and in the second station, the actuator keeps lying down on the housing.

Each of the first conductive contacts has a lower arm portion (13) and an upper arm portion (11) connected through a connecting portion (a fulcrum portion (12)) with the lower arm portion so as to form an H-shaped member. The lower arm portion is fixed to the housing and the upper arm portion is able to be seesaw with a fulcrum at the connecting portion. The holding portion of the first conductive contact for engaging with the actuator to hold the same is formed at an end of the upper arm portion of the first conductive contact.

The actuator is provided thereon with an engaging portion (42*a*) at a part thereof engaging with each of the first conductive contacts. The holding portion provided on each of the first conductive contacts is operative to engage with the engaging portion provided on the actuator for holding the actuator in its entirety and thereby the actuator is prevented from being unwillingly removed from the housing.

With the electrical connector proposed previously as shown in the above-mentioned published Japanese patent document, in which the first and second conductive contacts are arranged one after the other in the housing, the actuator postured to take up selectively the first station to keep rising from the housing and the second station to keep lying down on the housing is provided to be rotatable in regard to the housing, and each of the first conductive contacts is provided thereon with the holding portion for engaging with the actuator to hold the same, it is expected that the actuator is held by the holding portion provided on each of the first conductive contacts for engaging with the engaging portion provided on the actuator so that the actuator is prevented from being unwillingly removed from the housing. However, under the above-mentioned condition wherein it is expected that the actuator is prevented from being unwillingly removed from the housing, there are the following apprehensions.

The engaging portion provided on the actuator is moved in concurrence with the movements of the actuator between the first station wherein the actuator keeps rising from the housing and the second station wherein the actuator keeps lying down on the housing so as to shift in its posture and therefore it is feared that the holding portion provided on each of the first conductive contacts is not put in secure and stable mechanical engagement with the engaging portion provided on the actuator and thereby easily released from the engagement with the engaging portion provided on the actuator, for example, when the actuator is manipulated to rotate. Especially, when the actuator is put in the first station to keep rising from the housing, it is likely that the holding portion provided on each of the first conductive contacts is easily disengaged from the engaging portion provided on the actuator due to the shape of the engaging portion provided on the actuator.

As a result, with the previously proposed electrical connector in which the holding portion is provided on the conductive contact for engaging with the actuator to hold the same, it is hard to say that the actuator is surely and stably prevented from being unwillingly removed from the housing, for example, when the actuator is manipulated to rotate in regard to the housing.

BRIEF SUMMARY OF THE INVENTION

Accordingly, it is an object of the present invention to provide an electrical connector used, for example, for mounting a flat circuit device, such as an FPC or an FFC, on a circuit board device, such as a main solid circuit board of an electronic apparatus, which comprises a housing made of insulator and provided with an opening through which at least a part of the flat circuit device is inserted into the housing, a plurality of conductive contacts provided to be arranged on the housing, and an actuator provided to be rotatable in regard to the housing for engaging with the conductive contacts and operative to cause the conductive contacts to come into press-contact with connecting terminals provided on the flat circuit device having been inserted into the housing and then to release the conductive contacts from the press-contact with the connective contacts provided on the flat circuit device when the actuator is rotated in regard to the housing in respective predetermined directions, and which avoids the aforementioned disadvantages encountered with the prior art.

Another object of the present invention is to provide an electrical connector used, for example, for mounting a flat circuit device, such as an FPC or an FFC, on a circuit board device, such as a main solid circuit board of an electronic apparatus, which comprises a housing made of insulator and provided with an opening through which at least a part of the flat circuit device is inserted into the housing, a plurality of conductive contacts provided to be arranged on the housing, and an actuator provided to be rotatable in regard to the housing for engaging with the conductive contacts and operative to cause the conductive contacts to come into press-contact with connecting terminals provided on the flat circuit device having been inserted into the housing and then to release the conductive contacts from the press-contact with the connective contacts provided on the flat circuit device when the actuator is rotated in regard to the housing in respective predetermined directions, and with which the actuator can be surely and stably prevented from being removed unwillingly from the housing.

A further object of the present invention is to provide an electrical connector used, for example, for mounting a flat circuit device, such as an FPC or an FFC, on a circuit board device, such as a main solid circuit board of an electronic apparatus, which comprises a housing made of insulator and provided with an opening through which at least a part of the flat circuit device is inserted into the housing, a plurality of conductive contacts provided to be arranged on the housing, and an actuator provided to be rotatable in regard to the housing for engaging with the conductive contacts and operative to cause the conductive contacts to come into press-contact with connecting terminals provided on the flat circuit device having been inserted into the housing and then to release the conductive contacts from the press-contact with the connective contacts provided on the flat circuit device when rotated in regard to the housing in respective predetermined directions, and with which the actuator can be surely and stably prevented from being unwillingly removed from the housing with a relatively simple and miniaturized structure in the electrical connector.

According to the present invention, as claimed in any one of claims, there is provided an electrical connector, which comprises a housing made of insulator and provided with an opening through which a flat circuit device is inserted into the housing, a plurality of conductive contacts provided to be arranged on the housing to be positioned to correspond respectively to connecting terminals provided on the flat circuit device when the flat circuit device is inserted into the housing through the opening provided thereon, an actuator provided to elongate in a direction along which the conductive contacts are arranged and to be rotatable in regard to the housing for taking up a first station and a second station selectively and for engaging with the conductive contacts to cause each of the conductive contacts to come into press-contact with one of the connecting terminals corresponding thereto when the flat circuit device has been inserted into the housing through the opening provided thereon and the actuator is shifted from the first station to the second station and to release each of the conductive contacts from the press-contact with the corresponding one of the connecting terminals when the flat circuit device has been inserted into the housing and the actuator is shifted from the second station to the first station, and an engaging member attached to the housing for engaging with an end portion of the actuator to hold the same so that the actuator is prevented from being removed from the housing and for engaging with the flat circuit device inserted into the housing to hold the same so that the flat circuit device is prevented from getting out of the housing.

In one embodiment of the electrical connector according to the present invention, the engaging member is provided with a first movable holding portion for engaging with a projection formed at the end portion of the actuator to hold the same down in two directions perpendicular to each other and a second movable holding portion for engaging with an engaging portion provided on the flat circuit device to hold the flat circuit device.

When the electrical connector thus constituted in accordance with the present invention is put in practical use, the housing is mounted on a circuit board device, such as a main solid circuit board of an electrical apparatus. Hereinafter, as for the housing, an end portion on which the opening through which the flat circuit device is inserted into the housing is provided is referred to as a front end portion and another end portion opposite to the front end portion is referred to as a rear end portion.

In the electrical connector according to the present invention, the actuator put in the first station is postured to keep rising from the housing and the actuator put in the second station is postured to keep lying down on the housing. The actuator is shifted from the first station to the second station when the actuator is rotated in a first predetermined direction and then the actuator is further shifted from the second station to the first station when the actuator is rotated in a second predetermined direction opposite to the first predetermined direction.

The actuator thus postured to take up selectively the first station so as to keep rising from the housing and the second station so as to keep lying down on the housing, is prevented from being removed from the housing by the engaging member which engages with the end portion of the actuator elongating along an arrangement of the conductive contacts on the housing.

When the actuator is shifted from the first station to the second station under a condition wherein the flat circuit device has been inserted into the housing, each of the conductive contacts with which the actuator engages comes into press-contact with a corresponding one of the connecting terminals provided on the flat circuit device inserted into the housing. Then, when the actuator is shifted from the second station to the first station under the condition wherein the flat circuit device has been inserted into the housing, each of the conductive contacts with which the actuator engages is released from the press-contact with the corresponding one of the connecting terminals provided on the flat circuit device inserted into the housing.

The flat circuit device provided thereon with the connecting terminals with which the conductive contacts come into press-contact, is prevented from getting out of the housing by the engaging member which engages with not only the end portion of the actuator but also the flat circuit device inserted into the housing.

An embodiment of the engaging member is, for example, provided with the first movable holding portion for engaging with the projection formed at the end portion of the actuator to hold the same down in two directions perpendicular to each other and the second movable holding portion for engaging with the engaging portion provided on the flat circuit device to hold the flat circuit device.

With the electrical connector constituted in accordance with the present invention as described above, the actuator provided to be rotatable in regard to the housing is prevented from being removed from the housing by the engaging member operative to engage with the end portion of the actuator, for example, in such a manner that the first movable holding portion of the engaging member engages with the projection formed at the end portion of the actuator to hold the same down in two directions perpendicular to each other and the flat circuit device inserted into the housing is prevented from getting out of the housing by the engaging member operative to engage with the flat circuit device to hold the same, for example, in such a manner that the second movable holding portion of the engaging member engages with the engaging portion provided on the flat circuit device to hold the flat circuit device.

Accordingly, by means of the engaging member attached to the housing, not only the actuator provided to be rotatable in regard to the housing is prevented from being removed from the housing but also the flat circuit device inserted into the housing is prevented from getting out of the housing. On that occasion, the engaging member is operative to engage with the end portion of the actuator, for example, in such a manner that the first movable holding portion of the engaging member engages with the projection formed at the end portion of the actuator to hold the same down in two directions perpendicular to each other and further operative to engage with the flat circuit device to hold the same, for example, in such a manner that the second movable holding portion of the engaging member engages with the engaging portion provided on the flat circuit device to hold the flat circuit device. As a result, the actuator can be surely and stably prevented from being unwillingly removed from the housing with a relatively simple and miniaturized structure in the electrical connector and, in addition, the flat circuit device inserted into the housing can be surely and stably prevented from getting out of the housing unwillingly also with a relatively simple and miniaturized structure in the electrical connector.

The above, and other objects, features and advantages of the present invention will become apparent from the following detailed description taken in conjunction with the accompanying drawings.

DETAILED DESCRIPTION OF THE INVENTION

Figure 1:
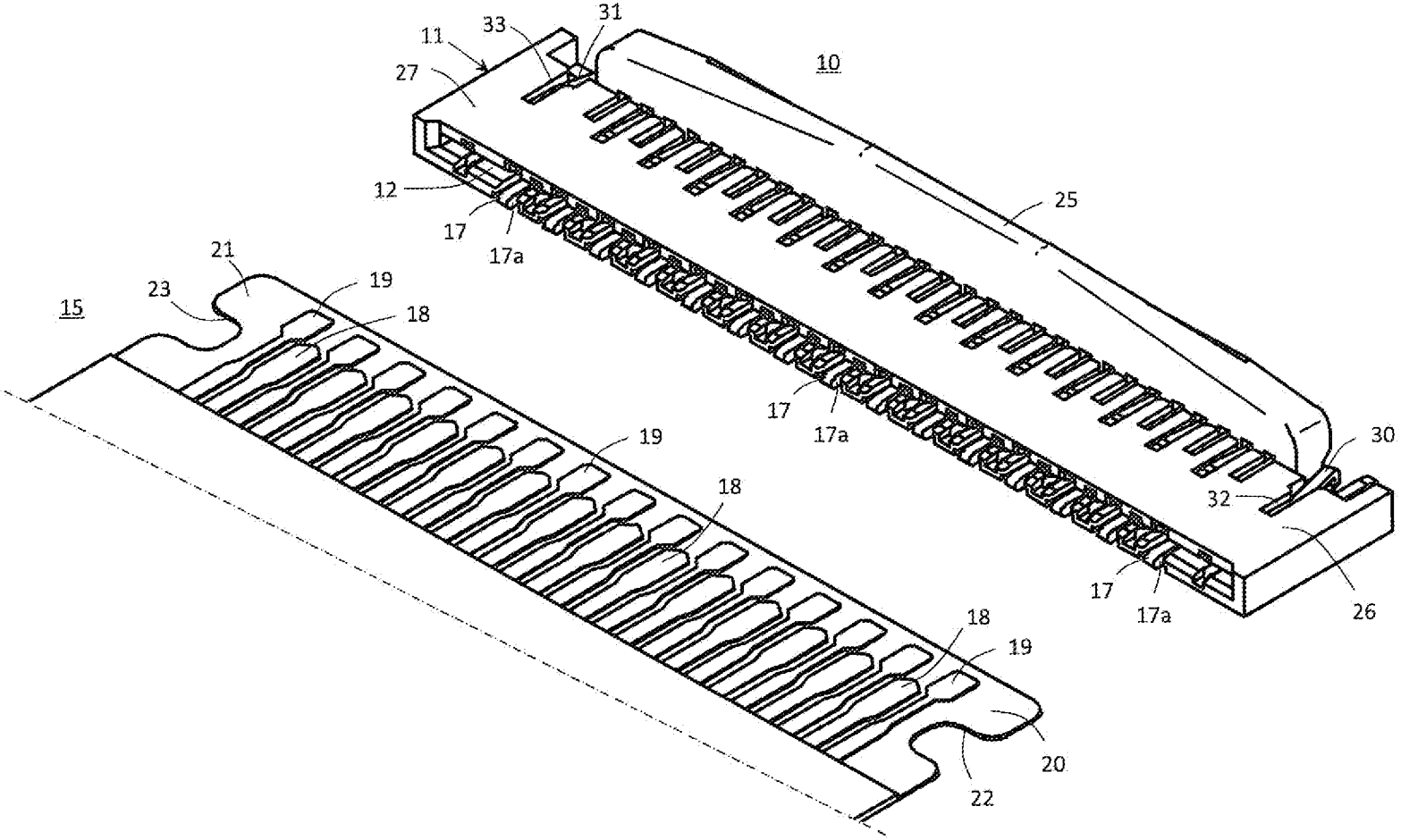
FIG. 1 is a schematic perspective view showing an embodiment of electrical connector according to the present invention, together with a part of an FPC which is to be inserted into the embodiment as a flat circuit device.
Figure 2:
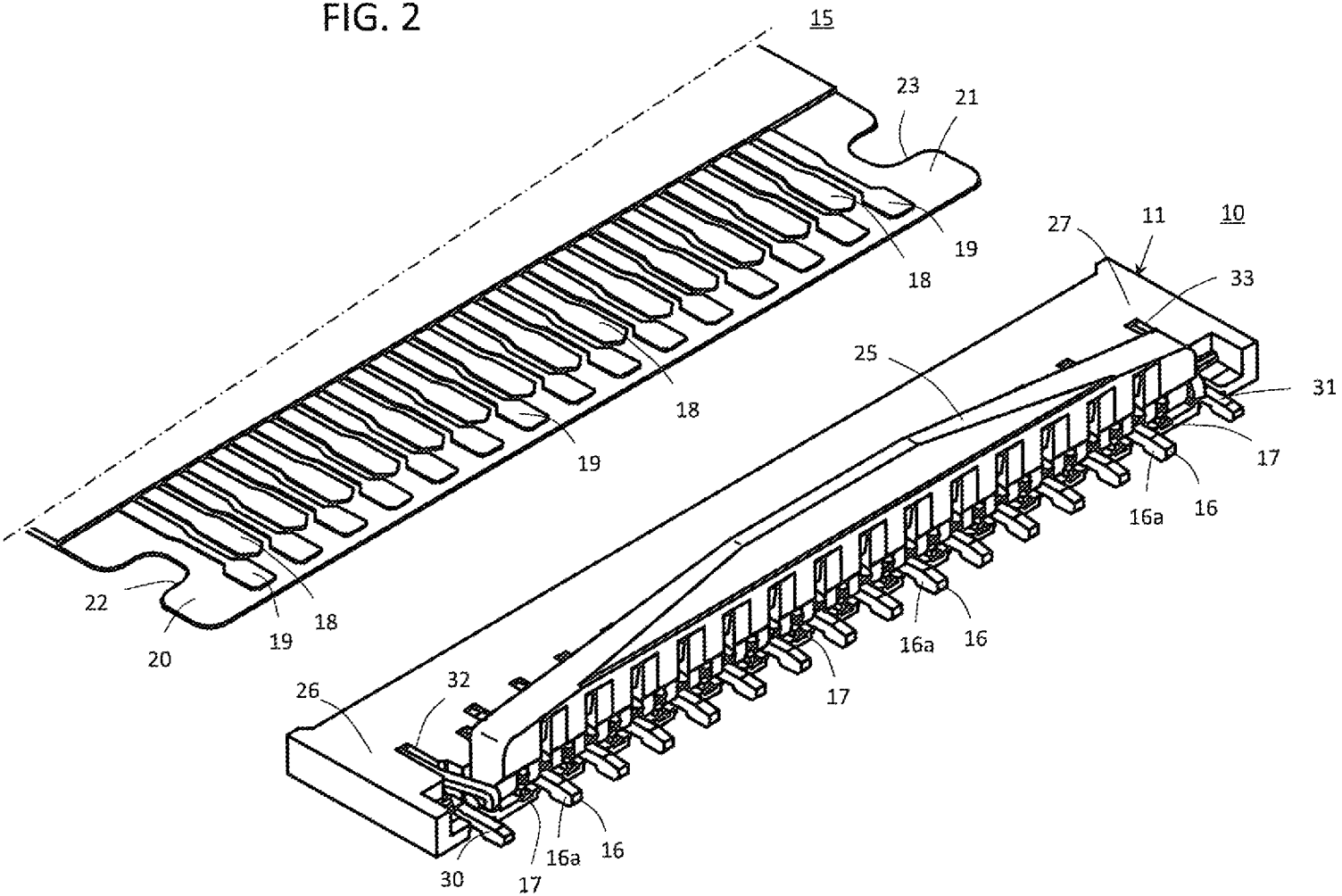
FIG. 2 is a schematic cross sectional view showing the embodiment of electrical connector shown in FIG. 1, together with the part of the FPC shown in FIG. 1.
Figure 3:
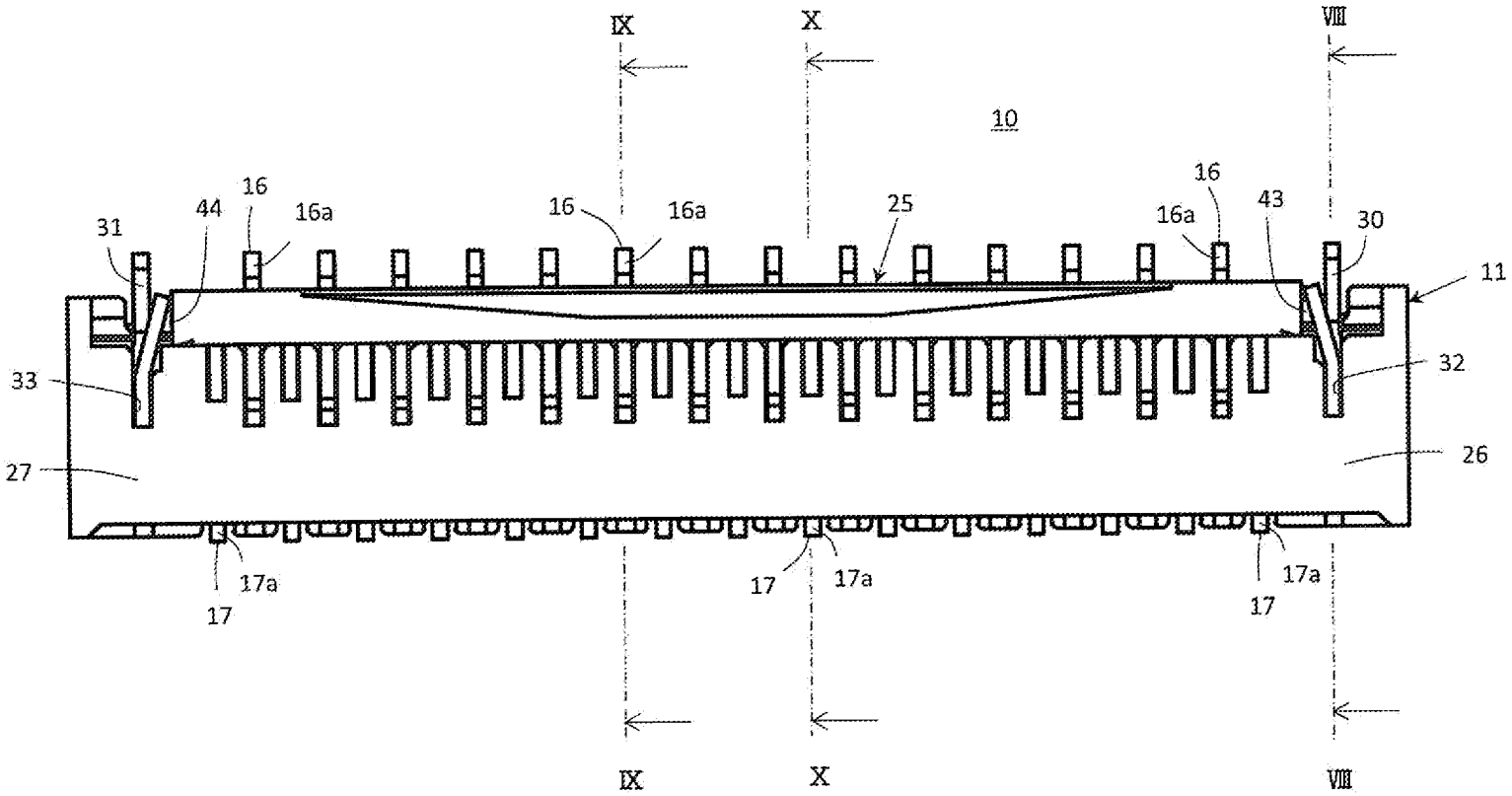
FIG. 3 is a schematic plan view showing the embodiment of electrical connector shown in FIG. 1.
Figure 4:
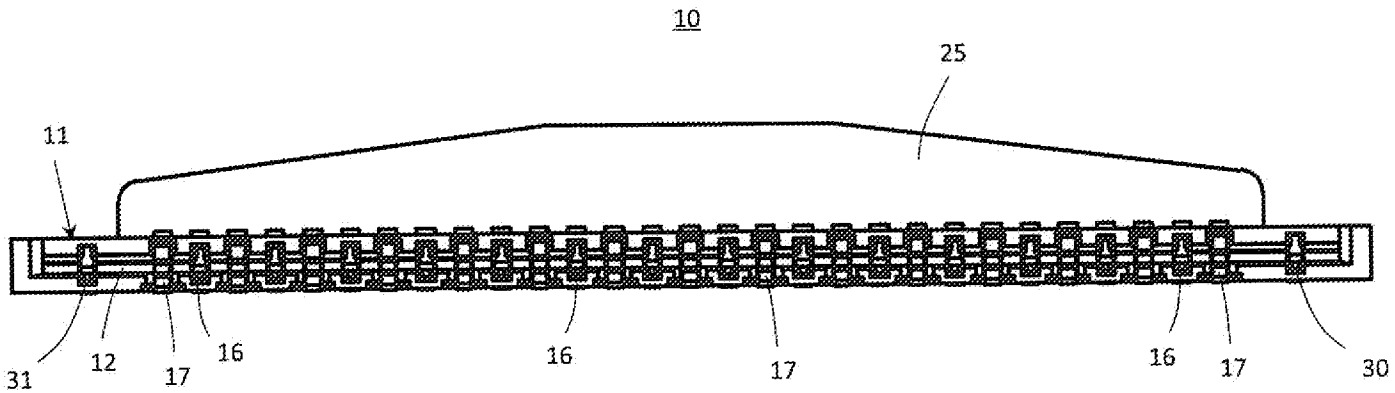
FIG. 4 is a schematic front view showing the embodiment of electrical connector shown in FIG. 1.
Figure 5:
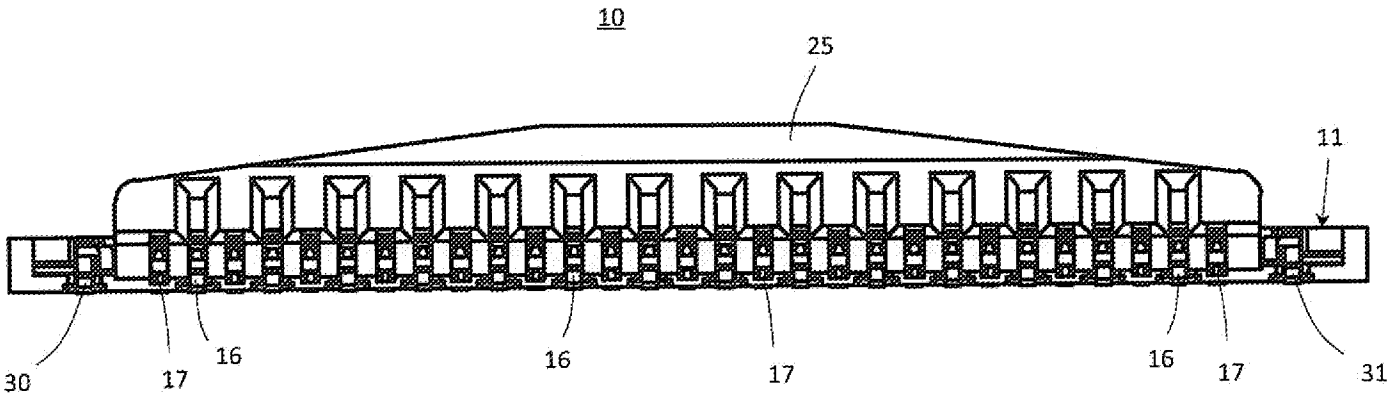
FIG. 5 is a schematic rear view showing the embodiment of electrical connector shown in FIG. 1.

FIGS. 1 and 2 show an embodiment of electrical connector according to the present invention, together with a part of a flat circuit device which is to be inserted into the embodiment. Further, FIGS. 3 to 5 show singly the embodiment of electrical connector shown in FIGS. 1 and 2.

Referring to FIGS. 1 to 5, an electrical connector 10, which constitutes the embodiment of electrical connector according to the present invention, has a housing 11 made of insulator such as plastics or the like. When the electrical connector 10 is put in practical use, the housing 11 is mounted on a circuit board device (not shown in the drawings), such as a main solid circuit board employed in an electronic apparatus.

The housing 11 is provided at a front end portion thereof with an opening 12 through which an FPC 15 is inserted into the housing 11 as the flat circuit device. In the inside of the housing 11, a flat circuit device accommodating room 13 (shown in FIGS. 8 to 10 explained later) is formed to extend from the opening 12 toward a rear end portion of the housing 11 for accommodating a part of the FPC 15 inserted through the opening 12 into the housing 11.

When the housing 11 is mounted on the circuit board device, the electrical connector 10 including the housing 11 is fixed as a whole to the circuit board device on which the housing 11 is mounted. Then, the FPC 15 is inserted through the opening 12 into the housing 11 mounted on the circuit board device so that the part of the FPC 15 is accommodated in the flat circuit device accommodating room 13 formed in the inside of the housing 11.

A plurality of first conductive contacts 16 each made of resilient conductive material and a plurality of second conductive contacts 17 each made of resilient conductive material are provided on the housing 11 of the electrical connector 10 to be arranged one after the other in a longitudinal direction of the housing 11. Each of the first conductive contacts 16 has a major portion thereof contained in the housing 11 and a connecting end portion 16*a* projecting from the rear end portion of the housing 11 to the outside thereof, as shown in FIGS. 2 and 3. Further, each of the second conductive contacts 17 has a major portion thereof contained in the housing 11 and a connecting end portion 17*a* projecting from the front end portion of the housing 11 to the outside thereof as shown in FIGS. 1 and 3.

On the part of the FPC 15, which is to be accommodated in the flat circuit device accommodating room 13 formed in the inside of the housing 11, a plurality of first connecting terminals 18 each made of conductive material and a plurality of second connecting terminals 19 each made of conductive material are provided to be arranged one after the other in a direction perpendicular to another direction along which the part of the FPC is inserted into the housing 11 and drawn out of the housing 11. Hereinafter, the part of the FPC 15 on which the first connecting terminals 18 and the second connecting terminals 19 are arranged one after the other is referred to as a terminal end portion. The FPC 15 has a pair of side end portions 20 and 21 opposite to each other so that the first connecting terminals 18 and the second connecting terminals 19 arranged one after the other on the terminal end portion are put between the side end portions 20 and 21 in the direction of an arrangement of the first connecting terminals 18 and the second connecting terminals 19. The side end portion 20 is provided thereon with an engaging edged recess 22 constituting an engaging portion of the FPC 15 and similarly the side end portion 21 is provided thereon with an engaging edged recess 23 constituting an engaging portion of the FPC 15.

In the housing 11, each of the first conductive contacts 16 is provided to be a signal contact operative to be connected with a corresponding one of the first connecting terminals 18 provided on the terminal end portion of the FPC 15 and each of the second conductive contacts 17 is provided also to be a signal contact operative to be connected with a corresponding one of the second connecting terminals 19 provided on the terminal end portion of the FPC 15. On occasion, it is also possible to use the first conductive contacts 16 and the second conductive contacts 17 as signal and ground contacts operative to be connected with signal connecting terminals and grounding terminals provided on a flat circuit device other than the FPC 15.

As to the housing 11, a direction along which the first conductive contacts 16 and the second conductive contacts 17 are arranged one after the other (hereinafter, referred to as a contact-arrangement direction) is defined as a lengthwise direction, a direction along which the part of the FPC 15 is inserted into and drawn out of the housing 11 through the opening 12 provided thereon is defined as a deep direction, and a direction perpendicular to each of the lengthwise and deep directions is defined as a thickness direction. When the FPC 15 is inserted into the housing 11 through the opening 12 provided thereon, a first surface of the FPC 15 on which the first connecting terminals 18 and the second connecting terminals 19 are arranged one after the other and a second surface of the FPC 15 opposite to the first surface of the FPC 15 are positioned to be opposite to each other in the deep direction of the housing 11.

The electrical connector 10 has, in addition to the housing 11, an actuator 25 which is provided on the side of the rear end portion of the housing 11 to be rotatable in regard to the housing 11. The actuator 25 is shaped into a long and narrow member elongating in the contact-arrangement direction, that is, the lengthwise direction of the housing 11, so that a longitudinal direction of the actuator 25 is the same as the lengthwise direction of the housing 11.

Figure 11:
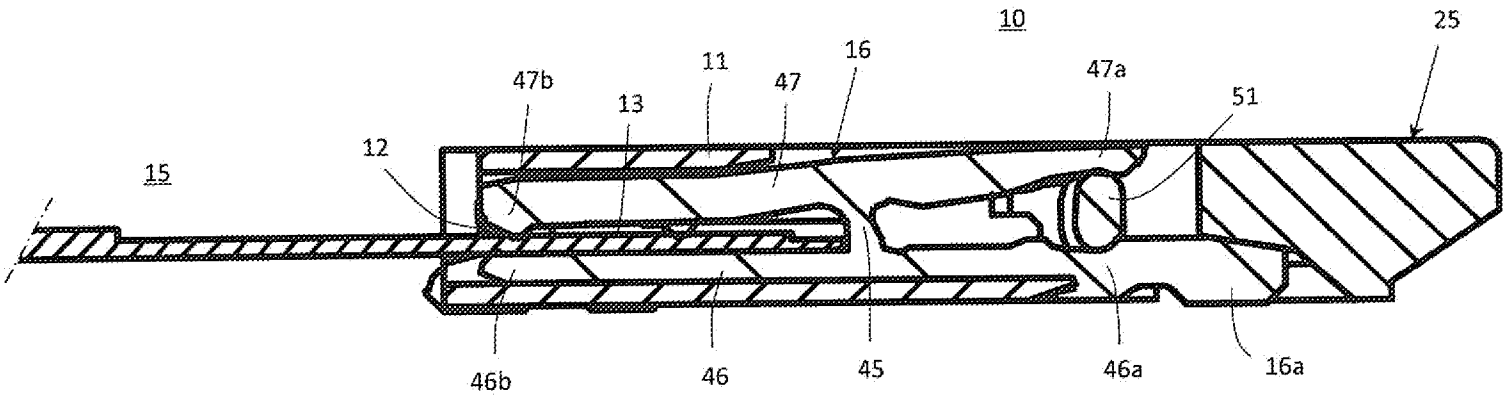
FIG. 11 is a schematic cross sectional view used for explaining a first conductive contact provided in the embodiment of electrical connector shown in FIG. 1.
Figure 12:
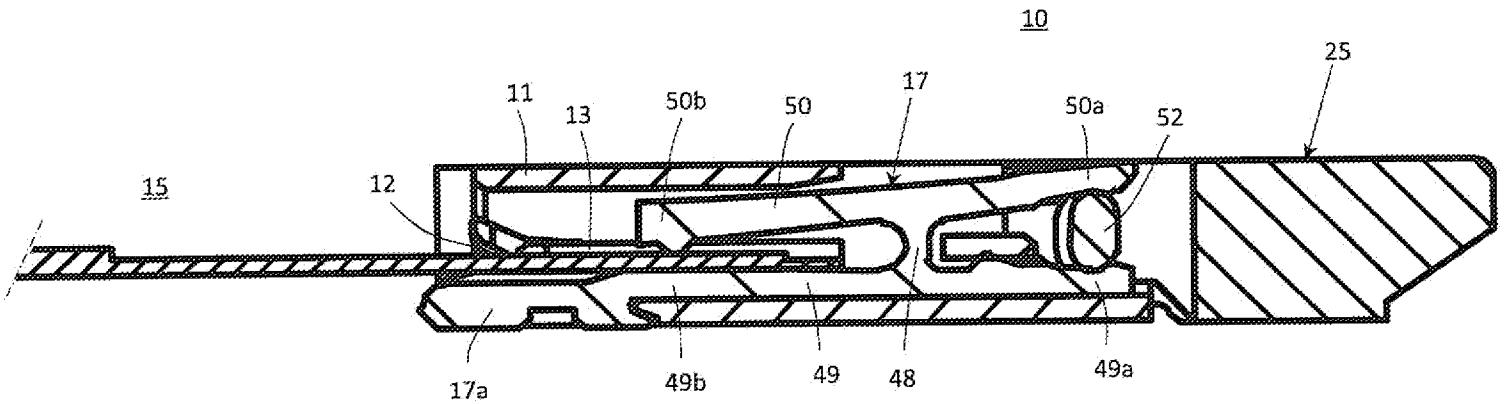
FIG. 12 is a schematic cross sectional view used for explaining a second conductive contact provided in the embodiment of electrical connector shown in FIG. 1.
Figure 13:
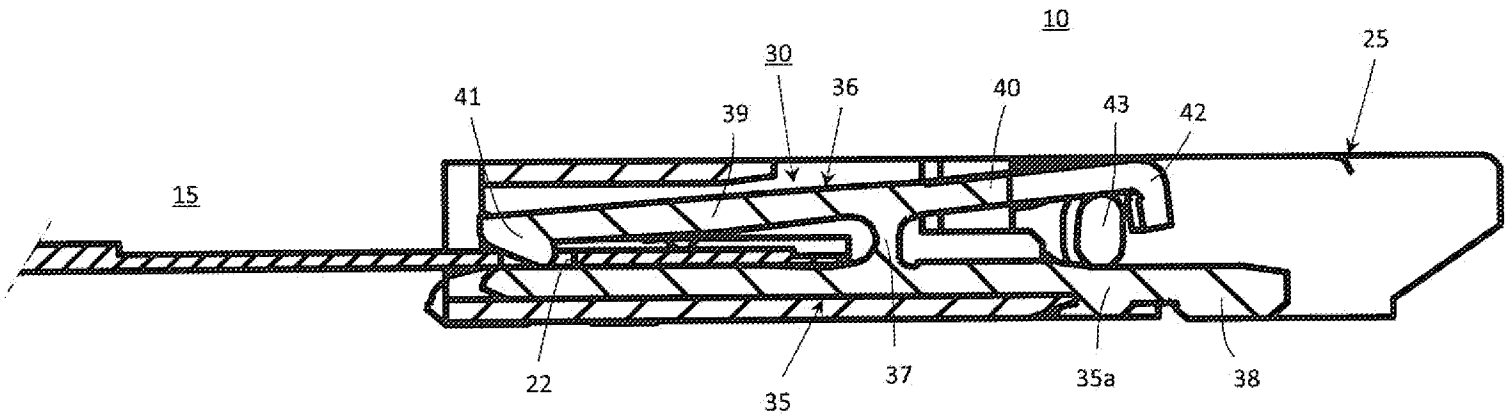
FIG. 13 is a schematic cross sectional view used for explaining the operation of the engaging member provided in the embodiment of electrical connector shown in FIG. 1.

The actuator 25 is postured to take up first and second stations selectively. In the first station, the actuator 25 keeps rising from the housing 11, as shown in FIGS. 1 to 5, and in the second station, the actuator 25 keeps lying down on the housing 11, as shown in FIGS. 11 to 13 described later. Then, the actuator 25 is rotated to shift from the first station to the second station or from the second station to the first station.

Further, the electrical connector 10 has a pair of engaging members 30 and 31 which are provided respectively at a pair of end portions 26 and 27 of the housing 11 opposite to each other in the lengthwise direction of the housing 11. Each of the engaging members 30 and 31 is made of, for example, resilient conductive material. The engaging member 30 has an end portion thereof extending from the rear end portion of the housing 11 to the outside thereof at the end portion 26 of the housing 11 and a body portion thereof put in a groove 32 provided on the housing 11 so that the engaging member 30 is held by the housing 11. Similarly, the engaging member 31 has an end portion thereof extending from the rear end portion of the housing 11 to the outside thereof at the end portion 27 of the housing 11 and a body portion thereof put in a groove 33 provided on the housing 11 so that the engaging member 31 is held by the housing 11.

Figure 6:
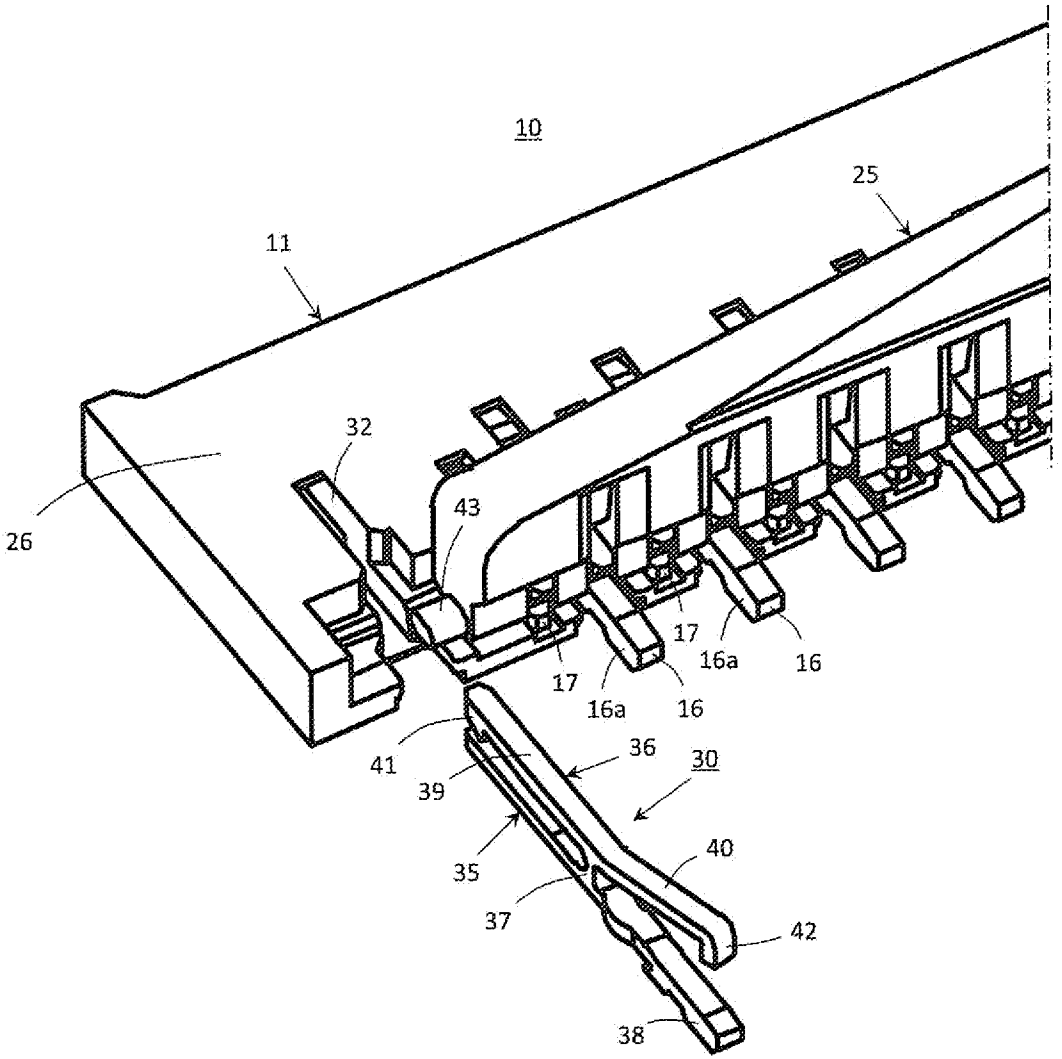
FIG. 6 is a schematic partially exploded perspective view used for explaining an engaging member provided in the embodiment of electrical connector shown in FIG. 1.

In more detail, as shown in FIG. 6, the engaging member 30 is provided thereon with a first beam 35 formed to be fixed to the housing 11, a second beam 36 formed to be movable in regard to the housing 11, and a connecting strut 37 for connecting mutually the first and second beams 35 and 36 with each other. The first beam 35 has a connecting terminal 38 at an end portion thereof. The second beam 36 has a first arm portion 39 and a second arm portion 40 between which an end portion of the connecting strut 37 is positioned and each of the first and second arm portions 39 and 40 is formed into a resilient cantilever. Therefore, the first and second arm portions 39 and 40, each of which is formed into the resilient cantilever, are provided to extend from the end portion of the connecting strut 37 to be positioned on respective sides opposite to each other.

A hook-shaped movable holding portion 41 is formed at an end of the first arm portion 39 extending from the end portion of the connecting strut 37 and a crooked movable holding portion 42 is formed at an end of the second arm portion 40 extending also from the end portion of the connecting strut 37. That is, the hook-shaped movable holding portion 41 and the crooked movable holding portion 42 are formed respectively at both end portions of the second beam 36 having the first and second arm portions 39 and 40.

The first arm portion 39 provided at the end thereof with the hook-shaped movable holding portion 41 is placed to face the first beam 35 and to be movable for approaching to or going away from the first beam 35. The second arm portion 40 provided at the end thereof with the crooked movable holding portion 42 is bent at the end portion of the connecting strut 37 toward a central portion of the housing 11 in the lengthwise direction of the housing 11 to be placed to get slightly out of a position facing rightly the first beam 35 and to be movable for approaching to or going away from the first beam 35.

Figure 7:
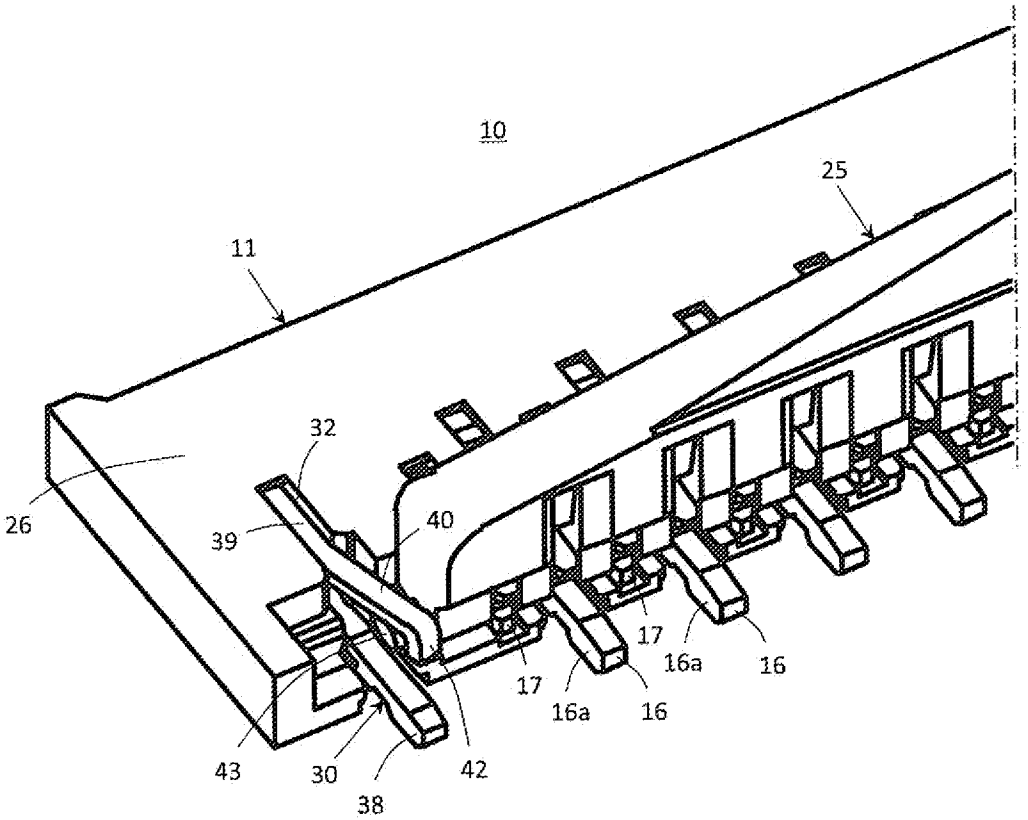
FIG. 7 is a schematic partial perspective view used for explaining the engaging member provided in the embodiment of electrical connector shown in FIG. 1.
Figure 8:
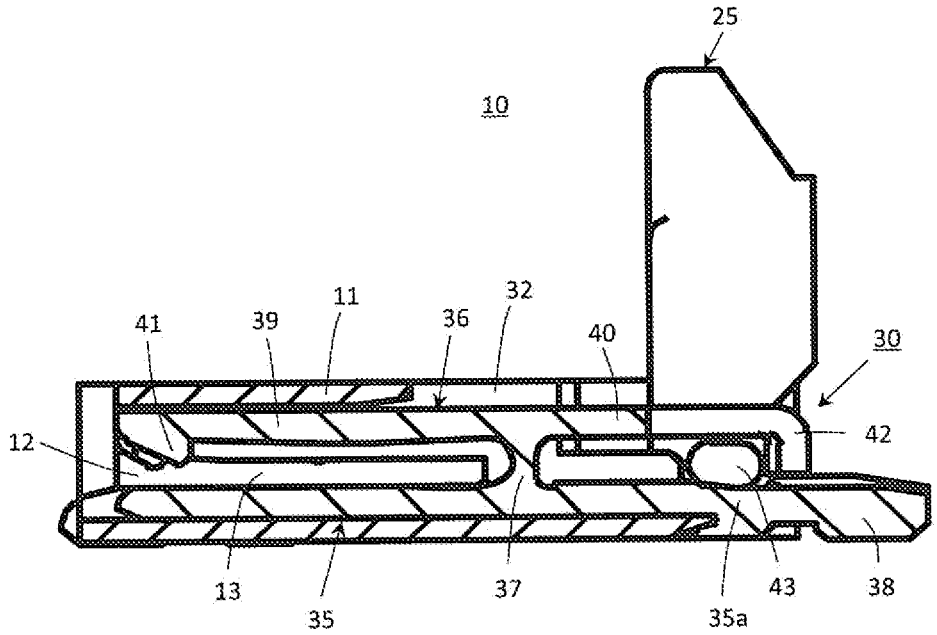
FIG. 8 is a schematic cross sectional view taken along line VIII-VIII in FIG. 3.

As shown in FIGS. 7 and 8 showing a cross section taken along line VIII-VIII in FIG. 3, the engaging member 30 which has the first beam 35, the second beam 36 and the connecting strut 37 is pushed in the housing 11 through the rear end portion thereof in such a manner that a major part of the first beam 35, a part of the second beam 36 forming the first arm portion 39 and the connecting strut 37 are put in the groove 32 formed on the housing 11 to be fixed to the housing 11. Each of the connecting terminal 38 provided at the end of the first beam 35 and the crooked movable holding portion 42 formed at the end of the second arm portion 40 of the second beam 36 projects from the rear end portion of the housing 11 to the outside thereof.

The crooked movable holding portion 42 formed at the end of the second arm portion 40 of the second beam 36 provided on the engaging member 30 is operative to engage with a projection 43 formed at one of a pair of end portions of the actuator 25 in the longitudinal direction thereof, that is, in the contact arrangement direction, to hold the same down in two directions perpendicular to each other, one of which is in parallel with the deep direction of the housing 11 and the other of which is in parallel with the thickness direction of the housing 11 so that the actuator 25 is prevented from being removed from the housing 11. Therefore, the engaging member 30 functions to engage with the end portion of the actuator 25 in the longitudinal direction thereof so as to prevent the actuator 25 from being removed from the housing 11.

The hook-shaped movable holding portion 41 formed at the end of the first arm portion 39 of the second beam 36 provided on the engaging member 30 is positioned in the flat circuit device accommodating room 13 formed in the inside of the housing 11. When the FPC 15 constituting the flat circuit device is inserted into the housing 11 through the opening 12 provided thereon and the terminal end portion of the FPC 15 is accommodated in the flat circuit device accommodating room 13 formed in the inside of the housing 11, the hook-shaped movable holding portion 41 is operative to engage with the engaging edged recess 22 provided on the side end portion 20 of the FPC 15, which constitutes the engaging portion of the FPC 15, and thereby to hold the FPC 15. Therefore, the engaging member 30 functions furthermore to hold the FPC 15 having the terminal end portion thereof accommodated in the flat circuit device accommodating room 13 formed in the inside of the housing 11 so as to prevent the FPC 15 from getting out of the housing 11.

Further, the engaging member 31 is constituted in the same manner as the engaging member 30 to be provided thereon with a first beam, a second beam and a connecting strut which correspond respectively to the first beam 35, the second beam 36 and the connecting strut 37 provided on the engaging member 30. The first beam has a connecting terminal at an end portion thereof and the second beam has a first arm portion and a second arm portion which correspond respectively to the first arm portion 39 and the second arm portion 40 of the second beam 36 provided on the engaging member 30.

A hook-shaped movable holding portion, which corresponds to the hook-shaped movable holding portion 41 formed at the end of the first arm portion 39 provided on the engaging member 30, is formed at an end of the first arm portion and a crooked movable holding portion, which corresponds to the crooked movable holding portion 42 formed at the end of the second arm portion 40 of the second beam 36 provided on the engaging member 30, is formed at an end of the second arm portion. That is, the hook-shaped movable holding portion and the crooked movable holding portion are formed respectively at both end portions of the second beam having the first and second arm portions. Then, the second arm portion provided at the end thereof with the crooked movable holding portion is bent at an end portion of the connecting strut toward the central portion of the housing 11 in the lengthwise direction of the housing 11 to be placed to get slightly out of a position facing rightly the first beam.

The engaging member 31 having thus the first beam, the second beam and the connecting strut is pushed in the housing 11 through the rear end portion thereof in such a manner that a major part of the first beam, a part of the second beam forming the first arm portion and the connecting strut are put in the groove 33 formed on the housing 11 to be fixed to the housing 11. The crooked movable holding portion formed at the end of the second arm portion of the second beam provided on the engaging member 31 is operative to engage with a projection 44 (shown in FIG. 3) formed at the other of the end portions of the actuator 25 in the longitudinal direction thereof, that is, in the contact arrangement direction, to hold the same down in two directions perpendicular to each other, one of which is in parallel with the deep direction of the housing 11 and the other of which is in parallel with the thickness direction of the housing 11 so that the actuator 25 is prevented from being removed from the housing 11. Therefore, the engaging member 31 also functions to engage with the end portion of the actuator 25 in the longitudinal direction thereof so as to prevent the actuator 25 from being removed from the housing 11.

The hook-shaped movable holding portion formed at the end of the first arm portion of the second beam provided on the engaging member 31 is positioned in the flat circuit device accommodating room 13 formed in the inside of the housing 11. When the FPC 15 constituting the flat circuit device is inserted into the housing 11 through the opening 12 provided thereon and the terminal end portion of the FPC 15 is accommodated in the flat circuit device accommodating room 13 formed in the inside of the housing 11, the hook-shaped movable holding portion formed at the end of the first arm portion of the second beam provided on the engaging member 31 is operative to engage with the engaging edged recess 23 provided on the side end portion 21 of the FPC 15, which constitutes the engaging portion of the FPC 15, and thereby to hold the FPC 15. Therefore, the engaging member 31 also functions furthermore to hold the FPC 15 having the terminal end portion thereof inserted into the housing 11 so as to prevent the FPC 15 from getting out of the housing 11.

Figure 9:
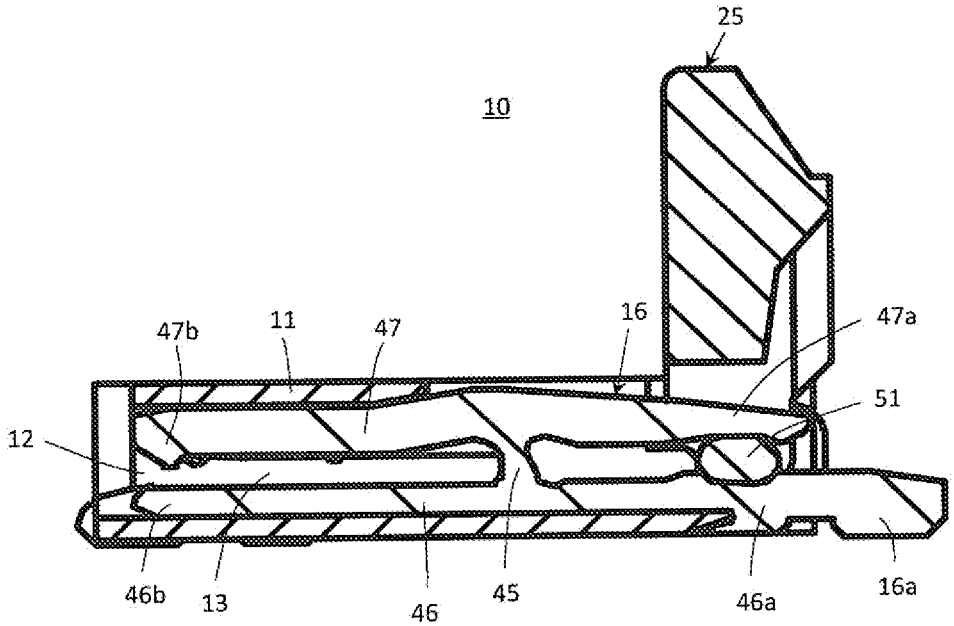
FIG. 9 is a schematic cross sectional view taken along line IX-IX in FIG. 3.

Each of the first conductive contacts 16 is made of conductive resilient material and formed entirely into an H-shaped plate member, as shown in FIG. 9 showing a cross section taken along line IX-IX in FIG. 3.

Referring to FIG. 9, the first conductive contact 16 formed entirely into the H-shaped plate member has a fixed beam 46 fixed to the housing 11, a movable beam 47 which is able to shift its position in the housing 11 for serving as an operating portion of the first conductive contact 16 and a connecting strut 45 for connecting the movable beam 47 with the fixed beam 46 to support the movable beam 47. A part of the fixed beam 46 positioned on the side of the opening 12 provided on the housing 11 and a part of the movable beam 47 positioned on the side of the opening 12 provided on the housing 11 to constitute the operating portion of the first conductive contact 16 are opposite to each other in the thickness direction of the housing 11 and positioned in the flat circuit device accommodating room 13 formed in the inside of the housing 11. An end of the fixed beam 46 projects from the rear end portion of the housing 11 to the outside thereof for forming the connecting end portion 16*a* of the first conductive contact 16 provided to be connected electrically with a conductive circuit pattern portion provided on the circuit board device on which the housing 11 is mounted.

Figure 10:
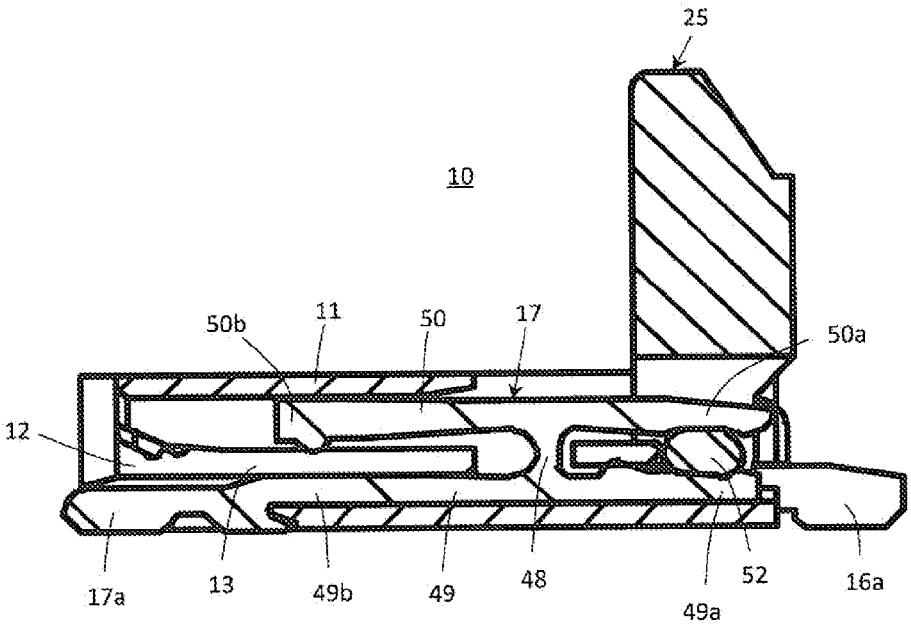
FIG. 10 is a schematic cross sectional view taken along line X-X in FIG. 3.

Further, each of the second conductive contacts 17 is also made of conductive resilient material and formed entirely into an H-shaped plate member, as shown in FIG. 10 showing a cross section taken along line X-X in FIG. 3.

Referring to FIG. 10, the second conductive contact 17 formed entirely into the H-shaped plate member has a fixed beam 49 fixed to the housing 11, a movable beam 50 which is able to shift its position in the housing 11 for serving as an operating portion of the second conductive contact 17 and a connecting strut 48 for connecting the movable beam 50 with the fixed beam 49 to support the movable beam 50. A part of the fixed beam 49 positioned on the side of the opening 12 provided on the housing 11 and a part of the movable beam 47 positioned on the side of the opening 12 provided on the housing 11 to constitute the operating portion of the second conductive contact 17 are opposite to each other in the thickness direction of the housing 11 and positioned in the flat circuit device accommodating room 13 formed in the inside of the housing 11. An end of the fixed beam 49 projects from the front end portion of the housing 11 to the outside thereof for forming the connecting end portion 17*a* of the second conductive contact 17 provided to be connected electrically with the conductive circuit pattern portion provided on the circuit board device on which the housing 11 is mounted.

As shown in FIGS. 9 and 10, the actuator 25, which is provided on the side of the rear end portion of the housing 11 to be rotatable in regard to the housing 11, has a plurality of cams 51, one of which is shown in FIG. 9, provided for engaging respectively with the first conductive contacts 16 and a plurality of cams 52, one of which is shown in FIG. 10, provided for engaging respectively with the second conductive contacts 17. Each of the cams 51 is put between a portion 46*a* of the fixed beam 46 provided on the first conductive contact 16 and an end portion 47*a* of the movable beam 47 provided on the first conductive contact 16 positioned to be opposite to the portion 46*a* of the fixed beam 46 so as to be rotatable with rotating movements of the actuator 25. The portion 46*a* of the fixed beam 46 is located to be close to the connecting end portion 16*a* of the first conductive contact 16. Similarly, each of the cams 52 is put between an end portion 49*a* of the fixed beam 49 provided on the second conductive contact 17 and an end portion 50*a* of the movable beam 50 provided on the second conductive contact 17 positioned to be opposite to the end portion 49*a* of the fixed beam 49 so as to be rotatable with rotating movements of the actuator 25.

Each of the projections 43 and 44 formed respectively at the end portions of the actuator 25 in the longitudinal direction thereof constitutes a cam provided to be rotatable with rotating movements of the actuator 25. As shown in FIG. 8, the projection 43 constituting the cam is put between a portion 35*a* of the first beam 35 provided on the engaging member 30 and the crooked movable holding portion 42 formed at the end of the second arm portion 40 of the second beam 36 provided on the engaging member 30. The portion 35*a* of the first beam 35 is located to be close to the connecting terminal 38 provided at the end of the first beam 35. Similarly, the projection 44 constituting the cam is put between a portion of the first beam provided on the engaging member 31, which is located to be close to the connecting terminal provided at the end of the first beam, and the crooked movable holding portion formed on the second arm portion provided on the engaging member 31.

Each of the cams 51 and 52 has an oval cross section, as shown in FIGS. 9 and 10, respectively. The oval cross section of each of the cams 51 and 52 has the maximum dimension measured across in a direction which varies with the rotating movement of the actuator 25. Hereinafter, this maximum dimension on the oval cross section of each of the cams 51 and 52 is referred to as the maximum cross-sectional dimension.

When the actuator 25 is postured to take up the first station as shown in FIGS. 1 to 5, portions of each of the cams 51 other than a portion thereof having the maximum cross-sectional dimension come into contact with the portion 46*a* of the fixed beam 46 provided on the first conductive contact 16 and the end portion 47*a* of the movable beam 47 provided on the first conductive contact 16, and portions of each of the cams 52 other than a portion thereof having the maximum cross-sectional dimension come into contact with the end portion 49*a* of the fixed beam 49 provided on the second conductive contact 17 and the end portion 50*a* of the movable beam 50 provided on the second conductive contact 17, Under such a situation, in each of the first conductive contact 16 with which the portions of the cam 51 other than the portion thereof having the maximum cross-sectional dimension engages, a relatively large space is made between an end portion 46*b* of the fixed beam 46 and an end portion 47*b* of the movable beam 47, as shown in FIG. 9, and in each of the second conductive contact 17 with which the portions of the cam 52 other than the portion thereof having the maximum cross-sectional dimension engages, a relatively large space is made between a portion 49*b* of the fixed beam 49 and an end portion 50*b* of the movable beam 50, as shown in FIG. 10. The portion 49*b* of the fixed beam 49 is located to be close to the connecting end portion 17*a* of the second conductive contact 17.

Further, the projection 43 formed at the end portion of the actuator 25 to constitute the cam has an oval cross section, as shown in FIG. 8 and similarly the projection 44 formed at the end portion of the actuator 25 to constitute the cam has an oval cross section. The oval cross section of each of the projections 43 and 44 has the maximum dimension measured across in a direction which varies with the rotating movement of the actuator 25. Hereinafter, this maximum dimension on the oval cross section of each of the projections 43 and 44 is also referred to as the maximum cross-sectional dimension.

Then, when the actuator 25 is postured to take up the first station as shown in FIGS. 1 to 5, portions of the projection 43 other than a portion thereof having the maximum cross-sectional dimension come into contact with the portion 35*a* of the first beam 35 provided on the engaging member 30 and the crooked movable holding portion 42 formed at the end of the second arm portion 40 of the second beam 36 provided on the engaging member 30, and portions of the projection 44 other than a portion thereof having the maximum cross-sectional dimension come into contact with the portion of the first beam provided on the engaging member 31 and the crooked movable holding portion formed at the end of the second arm portion of the second beam provided on the engaging member 31.

Under such a situation, in the engaging member 30 with which the portions of the projection 43 other than the portion thereof having the maximum cross-sectional dimension engages, a relatively large space is made between the hook-shaped movable holding portion 41 formed at the end of the first arm portion 39 of the second beam 36 provided on the engaging member 30 and the first beam 35 provided on the engaging member 30, as shown in FIG. 8, and in the engaging member 31 with which the portions of the projection 44 other than the portion thereof having the maximum cross-sectional dimension engages, a relatively large space is made between the hook-shaped movable holding portion formed on the first arm portion of the second beam provided on the engaging member 31 and the first beam provided on the engaging member 31.

In the electrical connector 10 constituted as described above, under a condition wherein the actuator 25 is postured to take up the first station, the FPC 15 shown in FIGS. 1 and 2 is inserted into the housing 11 through the opening 12 provided thereon along the deep direction of the housing 11. Then, when the insertion of the FPC 15 into the housing 11 has been completed, the terminal end portion of the FPC 15 is accommodated in the flat circuit device accommodating room 13 formed in the inside of the housing 11. That is, the FPC 15 is partially accommodated in the flat circuit device accommodating room 13. The terminal end portion of the FPC 15 thus accommodated in the flat circuit device accommodating room 13 formed in the inside of the housing 11 is put between a portion of the fixed beam 46 provided on each of the first conductive contacts 16 positioned on the side of the opening 12 provided on the housing 11 and a portion of the movable beam 47 provided on each of the first conductive contacts 16 positioned on the side of the opening 12 and between a portion of the fixed beam 49 provided on each of the second conductive contacts 17 positioned on the side of the opening 12 provided on the housing 11 and a portion of the movable beam 50 provided on each of the second conductive contacts 17 positioned on the side of the opening 12.

Under a condition wherein the terminal end portion of the FPC 15 is thus accommodated in the flat circuit device accommodating room 13 formed in the inside of the housing 11, the first conductive contacts 16 arranged on the housing 11 are positioned to correspond respectively to the first connecting terminals 18 provided on the terminal end portion of the FPC 15 and the second conductive contacts 17 arranged on the housing 11 are positioned to correspond respectively to the second connecting terminals 19 provided on the terminal end portion of the FPC 15. Further, the hook-shaped movable holding portion 41 formed at the end of the first arm portion 39 of the second beam 36 provided on the engaging member 30 is positioned to correspond to the engaging edged recess 22 formed on the side end portion 20 of the FPC 15 and the hook-shaped movable holding portion formed at the end of the first arm portion of the second beam provided on the engaging member 31 is positioned to correspond to the engaging edged recess 23 formed on the side end portion 21 of the FPC 15.

Then, when the actuator 25 is rotated to shift from the first station to the second station to be postured to take up the second station, as shown in FIGS. 11 to 13, each of the first and second conductive contacts 16 and 17 arranged one after the other on the housing 11 is operative to engage with the FPC 15 accommodated partially in the flat circuit device accommodating room 13 formed in the inside of the housing 11. In such engagements of the first and second conductive contacts 16 and 17 with the FPC 15, the first conductive contacts 16 come into press-contact with the first connecting terminals 18 provided on the terminal end portion of the FPC 15, respectively, and the second conductive contacts 17 come into press-contact with the second connecting terminals 19 provided on the terminal end portion of the FPC 15, respectively.

On such a occasion, first, under a condition wherein the actuator 25 is postured to take up the first station and the terminal end portion of the FPC 15 inserted into the housing 11 through the opening 12 provided thereon is put between the portion of the fixed beam 46 provided on each of the first conductive contacts 16 positioned on the side of the opening 12 and the portion of the movable beam 47 provided on each of the first conductive contacts 16 positioned on the side of the opening 12 and between the portion of the fixed beam 49 provided on each of the second conductive contacts 17 positioned on the side of the opening 12 and the portion of the movable beam 50 provided on each of the second conductive contacts 17 positioned on the side of the opening 12 in the flat circuit device accommodating room 13 formed in the inside of the housing 11, the actuator 25 taking up the first station is manipulated to rotate for shifting from the first station to the second station and to keep lying down on the housing 11 in the second station. Thereby, as shown in FIG. 11, the portion of each of the cams 51 on the actuator 25 having the maximum cross-sectional dimension comes into contact with the portion 46*a* of the fixed beam 46 provided on the first conductive contact 16 and the end portion 47*a* of the movable beam 47 provided on the first conductive contact 16 with the rotating movement of the actuator 25 from the first station to the second station.

The portion of each of the cams 51 on the actuator 25 having the maximum cross-sectional dimension, which is kept in contact with the portion 46*a* of the fixed beam 46 and the end portion 47*a* of the movable beam 47, is operative to shift the end portion 47*a* of the movable beam 47 to go away from the portion 46*a* of the fixed beam 46 so that the movable beam 47 is forced to reduce the space formed between the end portion 46*b* of the fixed beam 46 and the end portion 47*b* of the movable beam 47 if the terminal end portion of the FPC 15 is not accommodated in the flat circuit device accommodating room 13 formed in the inside of the housing 11. Thereby, the end portion 47*b* of the movable beam 47 comes into press-contact with a corresponding one of the first connecting terminals 18 on the terminal end portion of the FPC 15 accommodated in the flat circuit device accommodating room 13 formed in the inside of the housing 11 so that each of the first connecting terminals 18 provided on the terminal end portion of the FPC 15 is connected through the first conductive contact 16 electrically with the conductive circuit pattern portion provided on the circuit board device on which the housing 11 is mounted.

Further, as shown in FIG. 12, the portion of each of the cams 52 on the actuator 25 having the maximum cross-sectional dimension comes into contact with the end portion 49*a* of the fixed beam 49 provided on the second conductive contact 17 and the end portion 50*a* of the movable beam 50 provided on the first conductive contact 16 with the rotating movement of the actuator 25 from the first station to the second station.

The portion of each of the cams 52 on the actuator 25 having the maximum cross-sectional dimension, which is kept in contact with the end portion 49*a* of the fixed beam 49 and the end portion 50*a* of the movable beam 50, is operative to shift the end portion 50*a* of the movable beam 50 to go away from the end portion 49*a* of the fixed beam 49 so that the movable beam 50 is forced to reduce the space formed between the portion 49*b* of the fixed beam 49 and the end portion 50*b* of the movable beam 50 if the terminal end portion of the FPC 15 is not accommodated in the flat circuit device accommodating room 13 formed in the inside of the housing 11. Thereby, the end portion 50*b* of the movable beam 50 comes into press-contact with a corresponding one of the second connecting terminals 19 on the terminal end portion of the FPC 15 accommodated in the flat circuit device accommodating room 13 formed in the inside of the housing 11 so that each of the second connecting terminals 19 provided on the terminal end portion of the FPC 15 is connected through the second conductive contact 17 electrically with the conductive circuit pattern portion provided on the circuit board device on which the housing 11 is mounted.

Besides, as shown in FIG. 13, the portion of the projection 43 formed at the end portion of the actuator 25 having the maximum cross-sectional dimension comes into contact with the portion 35*a* of the first beam 35 provided on the engaging member 30 and the crooked movable holding portion 42 formed at the end of the second arm portion 40 of the second beam 36 provided on the engaging member 30 with the rotating movement of the actuator 25 from the first station to the second station.

The portion of the projection 43 formed at the end portion of the actuator 25 having the maximum cross-sectional dimension, which is kept in contact with the portion 35*a* of the first beam 35 and the crooked movable holding portion 42 formed at the end of the second arm portion 40 of the second beam 36, is operative to shift the crooked movable holding portion 42 formed at the end of the second arm portion 40 of the second beam 36 to go away from the portion 35*a* of the first beam 35 so that the second beam 36 is forced to cause the hook-shaped movable holding portion 41 formed at the end of the first arm portion 39 of the second beam 36 to approach to the first beam 35. Thereby, the hook-shaped movable holding portion 41 formed at the end of the first arm portion 39 of the second beam 36 engages with the engaging edged recess 22 formed on the side end portion 20 of the FPC 15 accommodated in the flat circuit device accommodating room 13 formed in the inside of the housing 11 to hold the FPC 15 so that the FPC 15 having the terminal end portion thereof inserted into the housing 11 is held by the engaging member 30 so as to be prevented thereby from getting out of the housing 11.

Similarly, the portion of the projection 44 formed at the end portion of the actuator 25 having the maximum cross-sectional dimension comes into contact with the portion of the first beam provided on the engaging member 31, which corresponds to the portion of the first beam 35 provided on the engaging member 30, and the crooked movable holding portion formed at the end of the second arm portion of the second beam provided on the engaging member 31, which corresponds to the crooked movable holding portion 42 formed at the end of the second arm portion 40 of the second beam 36 provided on the engaging member 30, with the rotating movement of the actuator 25 from the first station to the second station.

The portion of the projection 44 formed at the end portion of the actuator 25 having the maximum cross-sectional dimension, which is kept in contact with the portion of the first beam provided on the engaging member 31, which corresponds to the portion 35*a* of the first beam 35 provided on the engaging member 30, and the crooked movable holding portion formed at the end of the second arm portion of the second beam provided on the engaging member 31, which corresponds to the crooked movable holding portion 42 formed at the end of the second arm portion 40 of the second beam 36 provided on the engaging member 30, is operative to shift the crooked movable holding portion formed at the end of the second arm portion of the second beam provided on the engaging member 31 to go away from the portion of the first beam provided on the engaging member 31 so that the second beam provided on the engaging member 31 is forced to cause the hook-shaped movable holding portion formed at the end of the first arm portion of the second beam provided on the engaging member 31 to approach to the first beam provided on the engaging member 31. Thereby, the hook-shaped movable holding portion formed at the end of the first arm portion of the second beam provided on the engaging member 31 engages with the engaging edged recess 23 formed on the side end portion 21 of the FPC 15 accommodated in the flat circuit device accommodating room 13 formed in the inside of the housing 11 to hold the FPC 15 so that the FPC 15 having the terminal end portion thereof inserted into the housing 11 is held by the engaging member 31 so as to be prevented thereby from getting out of the housing 11.

After that, the actuator 25 postured to take up the second station, as shown in FIGS. 11 to 13, is manipulated to rotate from the second station to the first station for releasing each of the first conductive contacts 16 from the press-contact with the corresponding one of the first connecting terminals 18 on the terminal end portion of the FPC 15 and releasing also each of the second conductive contacts 17 from the press-contact with the corresponding one of the second connecting terminals 19 on the terminal end portion of the FPC 15, as occasion demands.

When the actuator 25 is manipulated to rotate from the second station to the first station to be postured to keep rising from the housing 11 in the first station, the portions of each of the cams 51 on the actuator 25 other than the portion thereof having the maximum cross-sectional dimension come into contact with the portion 46*a* of the fixed beam 46 provided on the first conductive contact 16 and the end portion 47*a* of the movable beam 47 provided on the first conductive contact 16 with the rotating movement of the actuator 25 from the second station to the first station.

The portions of each of the cams 51 on the actuator 25 other than the portion thereof having the maximum cross-sectional dimension, which are kept in contact with the portion 46*a* of the fixed beam 46 and the end portion 47*a* of the movable beam 47, are operative to shift the end portion 47*a* of the movable arm 47 to approach to the portion 46*a* of the fixed beam 46 so that the movable beam 47 is forced to broaden the space formed between the end portion 46*b* of the fixed beam 46 and the end portion 47*b* of the movable beam 47. Thereby, the end portion 47*b* of the movable beam 47 is released from the press-contact with the corresponding one of the first connecting terminals 18 on the terminal end portion of the FPC 15 accommodated in the flat circuit device accommodating room 13 formed in the inside of the housing 11.

Further, the portions of each of the cams 52 on the actuator 25 other than the portion thereof having the maximum cross-sectional dimension come into contact with the end portion 49*a* of the fixed beam 49 provided on the second conductive contact 17 and the end portion 50*a* of the movable beam 50 provided on the second conductive contact 17 with the rotating movement of the actuator 25 from the second station to the first station.

The portions of each of the cams 52 on the actuator 25 other than the portion thereof having the maximum cross-sectional dimension, which are kept in contact with the end portion 49*a* of the fixed beam 49 and the end portion 50*a* of the movable beam 50, are operative to shift the end portion 50*a* of the movable beam 50 to approach to the end portion 49*a* of the fixed beam 49 so that the movable beam 50 is forced to broaden the space formed between the portion 49*b* of the fixed beam 49 and the end portion 50*b* of the movable beam 50. Thereby, the portion 49*b* of the movable beam 49 is released from the press-contact with the corresponding one of the second connecting terminals 19 on the terminal end portion of the FPC 15 accommodated in the flat circuit device accommodating room 13 formed in the inside of the housing 11.

Besides, the portions of the projection 43 formed at the end portion of the actuator 25 other than the portion thereof having the maximum cross-sectional dimension comes into contact with the portion 35*a* of the first beam 35 provided on the engaging member 30 and the crooked movable holding portion 42 formed at the end of the second arm portion 40 of the second beam 36 provided on the engaging member 30 with the rotating movement of the actuator 25 from the second station to the first station.

The portions of the projection 43 formed at the end portion of the actuator 25 other than the portion thereof having the maximum cross-sectional dimension, which are kept in contact with the portion 35*a* of the first beam 35 and the crooked movable holding portion 42 formed at the end of the second arm portion 40 of the second beam 36, are operative to shift the crooked movable holding portion 42 formed at the end of the second arm portion 40 of the second beam 36 to approach to the portion 35*a* of the first beam 35 so that the second beam 36 is forced to cause the hook-shaped movable holding portion 41 formed at the end of the first arm portion 39 of the second beam 36 to go away from the first beam 35. Thereby, the hook-shaped movable holding portion 41 formed at the end of the first arm portion 39 of the second beam 36 is disengaged from with the engaging edged recess 22 formed on the side end portion 20 of the FPC 15 accommodated in the flat circuit device accommodating room 13 formed in the inside of the housing 11 to release the FPC 15 so that the FPC 15 having the terminal end portion thereof accommodated in the flat circuit device accommodating room 13 formed in the inside of the housing 11 is released from holding by the engaging member 30.

Similarly, the portions of the projection 44 formed at the end portion of the actuator 25 other than the portion thereof having the maximum cross-sectional dimension comes into contact with the portion of the first beam provided on the engaging member 31, which corresponds to the portion 35*a* of the first beam 35 provided on the engaging member 30, and the crooked movable holding portion formed at the end of the second arm portion of the second beam provided on the engaging member 31 with the rotating movement of the actuator 25 from the second station to the first station.

The portions of the projection 44 formed at the end portion of the actuator 25 other than the portion thereof having the maximum cross-sectional dimension, which are kept in contact with the portion of the first beam provided on the engaging member 31, which corresponds to the portion 35*a* of the first beam 35 provided on the engaging member 30, and the crooked movable holding portion formed at the end of the second arm portion of the second beam provided on the engaging member 31, are operative to shift the crooked movable holding portion formed at the end of the second arm portion of the second beam to approach to the portion of the first beam so that the second beam is forced to cause the hook-shaped movable holding portion formed at the end of the first arm portion of the second beam to go away from the first beam. Thereby, the hook-shaped movable holding portion formed at the end of the first arm portion of the second beam is disengaged from the engaging edged recess 23 formed on the side end portion 21 of the FPC 15 accommodated in the flat circuit device accommodating room 13 formed in the inside of the housing 11 to release the FPC 15 so that the FPC 15 having the terminal end portion thereof accommodated in the flat circuit device accommodating room 13 formed in the inside of the housing 11 is released from holding by the engaging member 31.

As a result, the FPC 15 having the terminal end portion thereof accommodated in the flat circuit device accommodating room 13 formed in the inside of the housing 11 is put in a condition for getting out of the housing 11.

With the electrical connector 10 thus constituted, the actuator 25 provided to be rotatable in regard to the housing 11 is prevented from being removed from the housing 11 by the engaging members 30 and 31 operative to engage respectively with the end portions of the actuator 25, for example, in such a manner that the crooked movable holding portion 42 of the engaging member 30 engages with the projection 43 formed at one of the end portions of the actuator 25 to hold the same down in two directions perpendicular to each other and the crooked movable holding portion of the engaging member 31 engages with the projection 44 formed at the other of the end portions of the actuator 25 to hold the same down in two directions perpendicular to each other, and further, the FPC 15 having the terminal end portion thereof accommodated in the flat circuit device accommodating room 13 formed in the inside of the housing 11 is prevented from getting out of the housing 11 by the engaging members 30 and 31 operative to engage with the FPC 15 to hold the same, for example, in such a manner that the hook-shaped movable holding portion 41 of the engaging member 30 engages with the engaging edged recess 22 formed on the side end portion 20 of the FPC 15 to hold the FPC 15 and the hook-shaped movable holding portion of the engaging member 31 engages with the engaging edged recess 23 formed on the side end portion 21 of the FPC 15 to hold the FPC 15.

Accordingly, by means of the engaging members 30 and 31 attached to the housing 11, not only the actuator 25 provided to be rotatable in regard to the housing 11 is prevented from being removed from the housing 11 but also the FPC 15 having the terminal end portion thereof accommodated in the flat circuit device accommodating room 13 formed in the inside of the housing 11 is prevented from getting out of the housing 11. On that occasion, the engaging members 30 and 31 are operative to engage respectively with the end portions of the actuator 25, for example, in such a manner that the crooked movable holding portion 42 of the engaging member 30 and the crooked movable holding portion of the engaging member 31 are put in respective engagements with the projections 43 and 44 formed respectively at the end portions of the actuator 25 to hold each of the projections 43 and 44 down in two directions perpendicular to each other, and further operative to engage with the FPC 15 to hold the same, for example, in such a manner that the hook-shaped movable holding portion 41 of the engaging member 30 and the hook-shaped movable holding portion of the engaging member 31 are put in respective engagements with the engaging edged recess 22 and 23 formed respectively on the side end portions 20 and 21 of the FPC 15 to hold the FPC 15. As a result, the actuator 25 can be surely and stably prevented from being unwillingly removed from the housing 11 with a relatively simple and miniaturized structure in the electrical connector 10 and, in addition, the FPC 15 having the terminal end portion thereof accommodated in the flat circuit device accommodating room 13 formed in the inside of the housing 11 can be surely and stably prevented from getting out of the housing 11 unwillingly also with a relatively simple and miniaturized structure in the electrical connector 10.

The invention claimed is:

1. An electrical connector comprising:

a housing made of insulator and provided with an opening through which a flat circuit device is inserted into the housing, a plurality of conductive contacts provided to be arranged on the housing so as to be positioned to correspond respectively to connecting terminals provided on the flat circuit device when the flat circuit device is inserted into the housing through the opening provided thereon, an actuator provided to elongate in a direction along which the conductive contacts are arranged and to be rotatable in regard to the housing for taking up a first station and a second station selectively and for engaging with the conductive contacts to cause each of the conductive contacts to come into press-contact with one of the connecting terminals corresponding thereto when the flat circuit device has been inserted into the housing through the opening provided thereon and the actuator is shifted from the first station to the second station and to release each of the conductive contacts from the press-contact with the corresponding one of the connecting terminals when the flat circuit device has been inserted into the housing and the actuator is shifted from the second station to the first station, and an engaging member attached to the housing and configured to engage with an end portion of the actuator to hold the end portion of the actuator to the housing so that the actuator is prevented from being removed from the housing, the engaging member is further configured to engage with the flat circuit device inserted into the housing to hold the flat circuit device to the housing so that the flat circuit device is prevented from getting out of the housing;

wherein said engaging member is provided with a first movable holding portion configured to engage with a projection formed at the end portion of the actuator to hold the actuator down in two directions perpendicular to each other and a second movable holding portion configured to engage with an engaging portion provided on the flat circuit device to hold the flat circuit device; and wherein said engaging member has a first beam provided to be fixed to the housing, a second beam provided to be movable in regard to the housing and a connecting strut configured to connect mutually the first and second beams with each other, and said first and second movable holding portions are provided respectively at a pair of end portions of the second beam.

2. An electrical connector according to claim 1, wherein said second beam of the engaging member has first and second arm portions between which an end portion of the connecting strut is positioned, the first arm portion is placed to face the first beam and the second arm portion is placed to get out of a position facing rightly the first beam.

3. An electrical connector according to claim 1, wherein said end portion of the actuator constitutes a cam provided to be rotatable with rotating movements of the actuator, said cam being operative to shift the first movable holding portion for causing the second movable holding portion to engage with the engaging portion provided on the flat circuit device for holding the flat circuit device when the actuator is moved from the first station to the second station and to disengage from the engaging portion provided on the flat circuit device for releasing the flat circuit device from holding by the second movable holding portion when the actuator is moved from the second station to the first station.

4. An electrical connector according to claim 1, wherein said engaging member is provided at each of end portions of the housing opposite to each other in the direction along which the conductive contacts are arranged.

* * * * *